United States Patent [19]

Stakelbeck

[11] 4,164,050

[45] Aug. 14, 1979

[54] TEXTILE TREATMENT PROCESS

[75] Inventor: Hans-Peter Stakelbeck, Binzen, Fed. Rep. of Germany

[73] Assignee: Sandoz Ltd., Basel, Switzerland

[21] Appl. No.: 849,838

[22] Filed: Nov. 9, 1977

[30] Foreign Application Priority Data

Nov. 11, 1976 [CH] Switzerland ..... 14211/76
Aug. 22, 1977 [CH] Switzerland ..... 10252/77

[51] Int. Cl.[2] ..... D06B 3/00; D06B 21/02

[52] U.S. Cl. ..... 8/149.1; 8/152; 68/5 C; 68/177

[58] Field of Search ..... 8/149.1, 152; 68/5 C, 68/20, 177, 178

[56] References Cited

U.S. PATENT DOCUMENTS 3,030,791 4/1962 Brown et al. ..... 68/177
4,084,412 4/1978 Levielle ..... 68/177 X

FOREIGN PATENT DOCUMENTS 2546897 4/1977 Fed. Rep. of Germany ..... 68/5 C
410557 4/1945 Italy ..... 8/149.1

*Primary Examiner*—Philip R. Coe
*Attorney, Agent, or Firm*—Gerald D. Sharkin; Richard E. Vila; Thomas C. Doyle

[57] ABSTRACT

Disclosed is a textile treatment process wherein a substrate is supported on one or more arms above a treatment liquor and is passed repeatedly through such liquor, characterised in that at least a part of that part of the substrate supported on the arm or arms and out of contact with the treatment liquor at any given time is heated employing heated air or steam, and that the liquor to goods ratio is in the range of from 5:1 to 15:1, and an apparatus suitable for performing such process.

10 Claims, 2 Drawing Figures

TEXTILE TREATMENT PROCESS

The present invention relates to an improved process and apparatus for use in textile treatments carried out on winch-beck and like devices.

Hitherto, processes employing winch-beck and like devices involve the support of the substrate, generally in endless form, on one or more horizontal arms, drive being applied to the substrate to convey same over the arm(s) and pass it repeatedly through a trough or sump of treatment liquor located below the arms. In general, at any given time the predominant part of the substrate is in contact with the liquor in the sump and only a small part, about 10%, is supported out of the liquor by the arms. Heat is applied to the liquor in the sump, either by means of heat exchangers in the liquor or by heating the sump itself. The maintenance of an even temperature in and throughout the liquor is generally effected by passage of the substrate or with the aid of rotary pumps. The maintenance and regulation of the liquor temperature need somewhat complex apparatus and technology for optimum results to be achieved. Additionally or alternatively, the effects of temperature irregularities, generally non-uniform dyeing, are compensated by increasing dyeing times. The liquor to goods ratio in such processes is generally of the order of from 15:1 to 40:1.

The process of the present invention is a radical departure from the above-described process.

Figure 1:
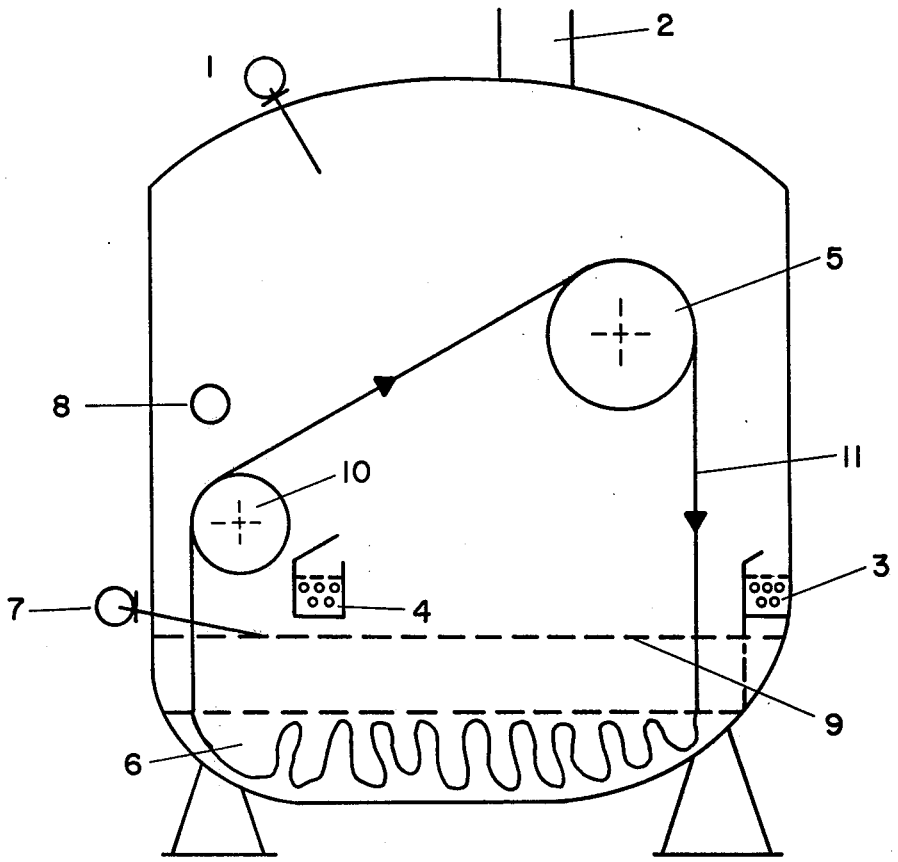
FIG. 1 illustrates one embodiment of an apparatus according to the invention in shcematic form.

Thus, according to the present invention, there is provided a textile treatment process wherein the substrate is supported on one or more arms above a treatment liquor and is passed repeatedly through such liquor, characterized in that at least a part of that part of the substrate supported on the arm or arms and out of contact with the treatment liquor at any given time is heated employing heated air or steam, and in that the liquor to goods ratio is in the range of from 5:1 to 15:1, preferably 5:1 to 10:1.

The radical departure of the process of the present invention from hitherto known processes lies in the fact that heat is applied to the substrate rather than to the liquor. If desired, of course, in the process of the invention, heat can heated air or steam, and in that the liquor to goods ratio is in the range of from 5:1 to 15:1, preferably 5:1 to 10:1.

The radical departure of the process of the present invention from hitherto known processes lies in the fact that heat is applied to the substrate rather than to the liquor. If desired, of course, in the process of the invention, heat can additionally be applied to the liquor, although this is not preferred. In the process of the invention, during the course of treatment, the liquor becomes heated by the passage therethrough of the heated substrate and this has been found to be sufficient, the low liquor to goods ratio being conducive to achievement of uniform temperature throughout the liquor at any given time and to a relatively steep rise in temperature of the liquor. The substrate is, of course, preferably heated uniformly across its full width.

If desired, as a preliminary step in the process of the invention, the textile substrate may be wetted out, preferably as uniformly as possible, with water. Also, if desired, the substrate may be pre-heated to stabilize the fibres, this conveniently being carried out in a "dry-run" i.e. without liquor present, the substrate, for example being conveyed over the arm(s) and through a dry liquor sump, whilst being heated, preferably with steam.

During the process of the invention the temperature of the substrate is preferably caused, by the application of the heated air or steam, to be raised to the temperature at which the components in the treatment liquor perform their function, e.g. in the case of dyeing or optical brightening, to the temperature of fixation of the dye or brightener. In general, and in a preferred mode of operation, during progress of the process of the invention, the heated air or steam gradually heats the substrate which, in turn, gradually heats the treatment liquor, the temperature differential between air or steam, substrate and liquor gradually diminishing during the treatment time until a stage is reached where a substantially uniform temperature is present throughout all three, which temperature is preferably in the range at which the components in the liquor perform their function. This mode of operation is illustrated in the graph shown in FIG. 2 of the accompanying drawings where temperature, in degrees centigrade, is plotted against time, in minutes, curve 1 being in respect of the steam or heated air (or rather of the atmosphere around the substrate supported on the arms), curve 2 being in respect of the substrate and curve 3 being in respect of the treatment liquor. As will be appreciated, the times and temperatures given in the graph are only illustrative and may be varied depending on the particular process being carried out.

As will be appreciated, the process of the invention is preferably carried out employing a closed housing or hood, i.e. a housing or hood which enables the heated air or steam to be contained around the substrate while the latter is supported on the arm(s). Absolute closure of the housing or hood is, of course, not necessary, and indeed one or more openings to facilitate air or steam circulation or to act as vents are desirable. The term "closed housing or hood" is to be understood accordingly. Such housings are generally employed in winch-beck textile treatment processes.

In general, in the process of the invention, an envelope of heated air or steam is caused to surround at least a part, preferably a predominant part, of that part of the substrate supported out of the treatment liquor, and extend across the full width of the substrate.

The invention further provides an apparatus suitable for performing the process of the invention, which apparatus comprises a sump or trough to hold a treatment liquor, one or more arms located above the sump or trough for support of a textile substrate, means for applying drive to the substrate to cause same to be conveyed over said arm(s) and through said sump or trough, a closed housing or hood to partially define a zone surrounding said arm(s) and at least a part of the path of the substrate when supported on said arm(s), one or more inlets for the supply of steam or heated air into said zone, and one or more temperature sensors located in said zone and coupled to means for controlling the ingress of steam or heated air into said zone.

Preferably, and as is conventional in the winch-beck dyeing art, the housing or hood and sump are joined or integral, that is to say together form a closed chamber. The term closed chamber is to be understood, in like manner. to closed housing or hood, not to be limited to absolute closure.

The temperature sensor(s) located in the zone defined by the housing or hood enable(s) monitoring of the temperature in the zone and is(are) preferably linked to a regulating device operable on the steam or hot air inlet(s) or source, to control same in order to regulate the temperature in the zone, e.g. according to a desired or predetermined value or pattern. Preferably two such sensors are employed, a first preferably in a location relatively removed from the sump or trough (generally in the upper region of the zone defined by the housing or hood) and one preferably in a location relatively close to the sump or trough (generally in the lower region of the zone defined by the housing or hood). The second mentioned temperature sensor is preferably arranged to act primarily as a hot air or steam sensor to detect and control the lower level of the hot air or steam at least during the initial phases of the treatment process when it is of advantage to maintain a distance between the heated zone and the treatment liquor. As the temperature of the air or steam, substrate and liquor reach equilibrium, this separation between the heated zone and the liquor generally disappears.

One embodiment of an apparatus according to the invention will now be described with reference to FIG. 1 of the accompanying drawings.

The apparatus is a modified conventional winch-beck dyeing apparatus in that in common with such apparatus it comprises two horizontally arranged winch arms 5 and 10 mounted in a closed chamber, the lower part of which chamber forms a sump for the liquor 6, the upper part of which forming a housing or hood surrounding the winch arms and path of substrate 11 when the substrate is supported on the winch arms. The direction of passage of the substrate is shown by the arrows. A controllable vent 2 is located in the roof of the chamber.

Unlike conventional winch-beck dyeing apparatus, however, the shown embodiment of the invention is not provided with any heating means for the sump, although such may be present but left inoperative. Instead, it comprises two steam or hot air inlets 3 and 4 which extend across the width of the chamber and two temperature sensors 1 and 7, sensor 1 being located adjacent the roof of the chamber, sensor 7 being located towards the bottom of the chamber but above the liquor level in the sump. A cold water sprinkler 8 is located adjacent the path of the substrate and extends across the width of the substrate.

In operation according to a preferred mode of the process of the invention, hot air or steam is let into the chamber through inlets 3 or 4 whilst the substrate is conveyed, preferably at a speed within the range of from 20 to 150 m/min, over winch arms 5 and 10 (one of which is driven) and transported through the liquor in the sump of the chamber. As the temperature rises in the zone surrounding the entrained substrate this is monitored by sensor 1 which, through a feedback device, is coupled to the inlets 3 and 4 (or alternatively to the source of hot air or steam) to control the temperature as desired. As the steam or hot air builds up in the upper part of the chamber the lower level of steam or hot air descends to a level 9, a short distance above the liquor 6, where it is detected by sensor 7. In the initial phases of the process, the lower level of steam or hot air is preferably maintained at this level 9, the sensor 7 being connected to a device for controlling the inlets 3 and 4 and the vent 2 and either more steam or air being fed into the chamber or some allowed to escape through vent 2 depending on whether the level 9 rises or falls.

Figure 2:
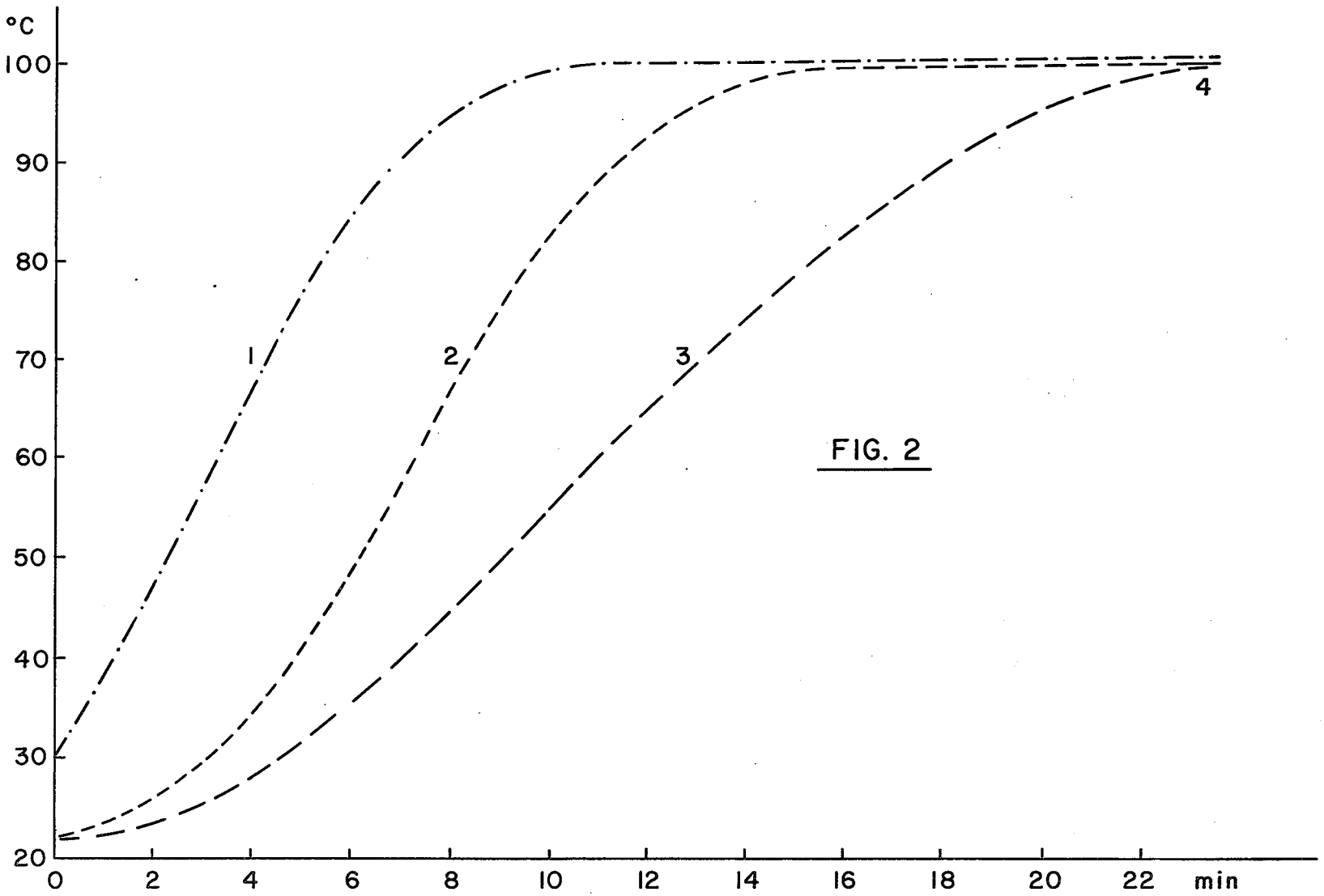
FIG. 2 illustrates a mode of operation of the invention in graph form.

During this phase of operation the temperature of the substrate rises and, due to its passage through the liquor, the temperature of the liquor consequently rises in the manner graphically represented in FIG. 2 of the drawings. As time passes, and as explained above, a stage is arrived whereat the temperature of the atmosphere around the entrained substrate, the temperature of the substrate and the temperature of the liquor become uniform, which temperature, in the case of dyeing and optical brightening processes, the preferred processes of the invention, lies in the fixation temperature range of the dye or brightener. Once this stage is reached there is no need to maintain the lower level of the hot air or steam above the liquor level and it may be allowed to fall. This "steady state" of temperature is then maintained for sufficient time for fixation to take place, after which the inlets 3 and 4 can be closed, vent 2 fully opened, the spent liquor run off and cold water sprayed onto the substrate from sprinkler 8 to cool and rinse the dyed substrate as it continues to be driven over arms 5 and 10.

The liquor employed in the process of the invention may contain, in addition to the main components therein e.g. dyestuff or optical brightening aids such as carriers and softening agents. It is of particular advantage, however, for the liquor to contain a surface active agent or the like to facilitate thorough wetting of the substrate.

As will be appreciated, to avoid or reduce slippage of the goods on the winch arms, driven roller pairs may be introduced along the path of the substrate.

Because of the low liquor to goods ratios employed in the process of the invention and the consequent lowering of buoyancy given to the substrate in the liquor, with some sump designs undue bunching of the substrate can occur at that end of the sump where the substrate enters the liquor. This, however, can be avoided by use of a ramp or slide sloping towards the centre of the sump.

The process and apparatus provided by the invention are particularly suitable for the processing, particularly dyeing, of carpets.

The process of the invention is further illustrated by the following Examples in which the parts and percentages are by weight and the temperatures in degrees centigrade.

EXAMPLE 1

Carpet material of polyamide 6, having a polypropylene backing is dyed in a liquor ratio of 1:8 in a modified carpet winch beck as in FIG. 1.

The dye liquor used contains the following components per 1000 parts:

0.1 parts of the dyestuff of the following structural formula

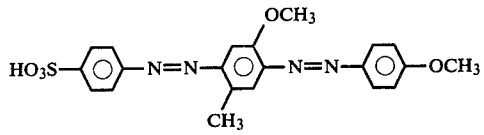

0.2 parts of the dyestuff C.I. Acid Red 57

0.4 parts of the dyestuff C.I. Acid Blue 288

0.3 parts of a commercial wetting agent based on a higher alkylbenzene sulphonate 1 part of a mixture of the following components:

400 parts of benzyl alcohol
450 parts of monophenylglycol ether
150 parts of octylphenylpentaglycol ether
0.05 parts of 60% acetic acid.

The carpet is moved over the winch and the process carried out as hereinbefore described, steam or hot air being fed into the chamber, whereby the substrate, over a period of 10 to 60 minutes is heated to a temperature between 60° to 100°. After the stage is reached whereat the atmosphere, substrate and liquor are at a substantially uniform temperature, the temperature is maintained for a further 10 to 60 minutes for fixation to take place, whereafter the heating is stopped and the substrate cooled and rinsed by allowing water to flow in, and spraying with water.

An evenly dyed carpet is obtained.

EXAMPLE 2

A polyamide carpet material with a polypropylene backing is dyed in similar manner to that described in Example 1, at a liquor to goods ratio of 8:1 employing a liquor containing, per 1000 parts:

0.55 parts C.I. Acid Orange 156
0.3 parts C.I. Acid Red 57
0.42 parts C.I. Acid Blue 40
0.6 parts of a commercial foam dampening wetting agent based on a higher alkylbenzene sulphonate and
0.15 parts of 60% acetic acid.

A level brown dyed carpet results.

EXAMPLE 3

A loop pile carpet material of mixed basic and acid dyeable polyamide yarns with a polypropylene backing is dyed in similar manner to that set out in Example 1 with a liquor containing, per 1000 parts:

0.26 parts C.I. Acid Orange 145
0.05 parts C.I. Acid Red 57
0.1 parts C.I. Acid Blue 72
0.07 parts C.I. Basic Orange 37
0.02 parts C.I. Basic Red 23
0.022 parts C.I. Basic Blue 22
0.6 parts commercial foam dampening wetting agent based on a higher alkylbenzene sulphonate
0.6 parts commercial wetting agent based on a polyglycol behenylamine
0.1 part acetic acid 60%.

A differential level dyed carpet results.

EXAMPLE 4

A cut-loop polyamide carpet material with polypropylene backing is dyed following the procedure of Example 1 employing a liquor containing, per 1000 parts:

0.98 parts C.I. Acid Yellow 219
0.14 parts C.I. Acid Red 57
0.11 parts C.I. Acid Blue 40
0.3 parts commercial wetting agent based on an aromatic sulphonate
0.1 part acetic acid 60%.

A level dyed carpet results.

EXAMPLE 5

A cut loop mixed polyamide/polyester carpet material with a polypropylene backing is dyed in similar manner to Example 1 with a liquor containing, per 1000 parts:

0.04 parts C.I. Disperse Yellow 57
0.05 parts C.I. Disperse Red 53
0.02 parts C.I. Disperse Blue 56
1.0 part commercial highly sulphonated anionic oil sulphonate
0.5 parts commercial aliphatic polyglycolether.

A level dyed beige carpet results.

EXAMPLE 6

A cup pile polyamide carpet material with a polypropylene backing is dyed in similar manner to Example 1 with a liquor containing, per 1000 parts:

0.6 parts C.I. Acid Yellow 196
1.0 part C.I. Acid Orange 156
0.3 parts commercial wetting agent based on an aromatic sulphonate
0.8 parts softener based on a fatty acid derivative
0.3 parts acetic acid 60%.

A soft, voluminous, level dyed carpet results.

EXAMPLE 7

A loop pile carpet material of basic dyeable polyamide with a polypropylene backing is dyed in similar manner to Example 1 with a liquor containing, per 1000 parts:

0.6 parts C.I. Acid Orange 145
0.03 parts C.I. Acid Red 57
0.14 parts C.I. Acid Blue 72
0.6 parts C.I. Basic Orange 57
0.7 parts of an acid liberator (γ-butyrolactone)
0.3 parts commercial wetting agent based on higher alkylbenzene sulphonate
0.3 parts commercial wetting agent based on a polyglycolated behenylamine.

A differential, level dyed carpet results.

EXAMPLE 8

A cut-pile polyamide carpet with a polypropylene backing was dyed in similar manner to that described in Example 1 in a liquor containing, per 1000 parts:

0.15 parts C.I. Acid Orange 156
0.1 parts C.I. Acid Red 57
0.12 parts C.I. Acid Blue 40
0.3 parts commercial wetting agent based on an aromatic sulphonate, and
0.5 parts Borax.

In this case, however, a liquor to goods ratio of 1:9 was employed and the carpet material was repeatedly passed through the liquor whilst maintaining the temperature of the atmosphere in the chamber between 85° and 95° for from 10 to 20 minutes. By addition of 0.7 parts of γ-butyrolactone to the liquor the desired exhaustion was achieved. The carpet then further transported whilst maintaining the temperature to effect fixation of the dyeing.

What we claim is:

1. In a textile treatment process wherein the textile substrate to be treated is supported above a treatment liquor and is passed repeatedly through such liquor in such manner that at any given time part of said substrate is in contact with the liquor and part is supported out of the liquor, the improvement wherein the liquor to goods ratio is in the range of 5:1 to 15:1 and an envelope of heated air or steam is caused to surround and heat at least a part of that part of the substrate which is supported out of contact with the treatment liquor, said envelope of heated air or steam being maintained at a distance above the liquor at least until a substantially uniform temperature is achieved between the heated air or steam, the substrate and the liquor, said liquor being heated by passage therethrough of the heated substrate.

2. A process according to claim 1, wherein the heat is applied for a length of time sufficient for a substantially uniform temperature to be achieved between the air or steam, the substrate and the liquor, the liquor being heated by passage therethrough of the substrate.

3. A process according to claim 2, wherein said temperature is in the range at which the components in the liquor perform their function.

4. A process according to claim 3, wherein said temperature is maintained for a sufficient time for the components to perform their function.

5. A process according to claim 1 wherein the substrate is in endless form and is supported on one or more arms above the treatment liquor and is conveyed over said arms(s) and through said liquor such that at any given time part of said substrate is in contact with the liquor and part is supported out of the liquor by the arm(s).

6. A process according to claim 5, wherein a substantial part of that part of the substrate supported on the arm or arms is heated.

7. A process according to claim 5 which comprises supporting the textile substrate on one or more arms above a sump or trough holding the treatment liquor, said arms and at least a part of the path of the substrate when supported on said arm(s) being in a zone defined by a closed housing or hood, conveying the substrate over said arm(s) by applying drive thereto from suitable driving means, monitoring the temperature in said zone by temperature sensing means in said zone and controlling the ingress or hot air or steam into said zone by means coupled to said temperature sensing means.

8. A process according to claim 7 which comprises monitoring the temperature in a region of the zone remote from the treatment liquor and also in a region relatively close to the treatment liquor.

9. A process according to claim 8 which comprises controlling the ingress of hot air or steam into said zone by means responsive to the temperature monitored in the region of the zone close to the treatment liquor, whereby the desired distance between the heated air or steam in said zone and the treatment liquor is maintained.

10. A process according to claim 5 wherein the treatment liquor is for dyeing or optional brightening.

* * * * *

UNITED STATES PATENT AND TRADEMARK OFFICE

CERTIFICATE OF CORRECTION

PATENT NO. : 4,164,050

DATED : August 14, 1979

INVENTOR(S) : Hans-Peter Stakelbeck

It is certified that error appears in the above—identified patent and that said Letters Patent is hereby corrected as shown below:

Column 1, lines 45-51; delete the entire paragraph.

Signed and Sealed this

*Ninth* Day of *September 1980*

[SEAL]

*Attest:*

SIDNEY A. DIAMOND

*Attesting Officer*

*Commissioner of Patents and Trademarks*